US006769682B2

(12) United States Patent
Sumi et al.

(10) Patent No.: US 6,769,682 B2
(45) Date of Patent: Aug. 3, 2004

(54) DEVICE FOR REVERSING DIRECTION OF MOTION OF PAPER SHEET

(75) Inventors: Masaaki Sumi, Gifu (JP); Koji Kirino, Bisai (JP)

(73) Assignee: Omron Corporation, Kyoto (JP)

( * ) Notice: Subject to any disclaimer, the term of this patent is extended or adjusted under 35 U.S.C. 154(b) by 25 days.

(21) Appl. No.: 10/255,130

(22) Filed: Sep. 24, 2002

(65) Prior Publication Data

US 2003/0071409 A1 Apr. 17, 2003

(30) Foreign Application Priority Data

Sep. 28, 2001 (JP) ..... 2001-302524

(51) Int. Cl.[7] ..... B65H 29/00
(52) U.S. Cl. ..... 271/186; 271/902
(58) Field of Search ..... 271/186, 902, 271/182

(56) References Cited

U.S. PATENT DOCUMENTS 4,346,880 A * 8/1982 Roller et al. ..... 271/186
4,359,217 A * 11/1982 Roller et al. ..... 271/186
4,487,506 A * 12/1984 Repp et al. ..... 399/401
4,512,255 A * 4/1985 Crist ..... 101/230
4,986,529 A * 1/1991 Agarwal et al. ..... 271/291
5,082,272 A * 1/1992 Xydias et al. ..... 271/186
5,265,864 A * 11/1993 Roux et al. ..... 271/186
5,383,656 A * 1/1995 Mandel et al. ..... 271/258.01
5,449,164 A * 9/1995 Quesnel et al. ..... 271/186
5,720,478 A * 2/1998 Carter et al. ..... 271/186
5,887,868 A * 3/1999 Lambert et al. ..... 271/186
6,065,746 A * 5/2000 Tranquilla ..... 271/176
6,394,447 B1 * 5/2002 Kawai et al. ..... 271/186

* cited by examiner

*Primary Examiner*—Donald P. Walsh
*Assistant Examiner*—Matthew J. Kohner
(74) *Attorney, Agent, or Firm*—Beyer Weaver & Thomas LLP

(57) ABSTRACT

A device for reversing the direction of motion of a paper sheet has a passage for guiding the paper sheet inside and includes a plurality of rollers each having a specified function. A first roller serves as a driver roller, its rotation causing the paper sheet to be transported into and out of the passage. A second roller is for contacting and rotating with the first roller and thereby transporting the paper sheet in the first direction into the passage. A third roller is disposed on the opposite side of the first roller from the second roller and serves to transport the paper sheet in the second direction out of the passage by contacting and rotating with the first roller. A fourth roller is another driver roller and is disposed in the passage. It allows the front edge of the paper sheet to pass by when it is transported in the first direction by means of the first and second rollers. When the paper sheet has passed between the first and second rollers and its back edge has been disengaged from them, a guiding member pushes and guides the back edge of the paper sheet towards the third roller and the four roller rotates so as to transport the paper sheet in the second direction out of the device.

8 Claims, 8 Drawing Sheets

DEVICE FOR REVERSING DIRECTION OF MOTION OF PAPER SHEET

BACKGROUND OF THE INVENTION

This invention relates to a device for reversing the direction of motion of a paper sheet and more particularly to such a device capable of dependably reversing the direction of transportation of a paper sheet, independent of its material quality or shape.

Such devices for reversing the direction of motion of a paper sheet are recently coming to be used frequently in apparatus such as copiers, printers and facsimile machines. FIG. 1 shows an example of prior art paper reversing device 1 of this kind, disclosed in Japanese Patent Publication Tokkai 8-67390, provided with a passage 15 extending vertically between a pair of guide plates 14*a* and 14*b* for guiding a paper sheet vertically upward and downward. An upper driver roller 11, adapted to rotate in the counter-clockwise direction by means of a motor (not shown), is disposed at one end position ("the start position") 15*a* of the passage 15. A paper-supplying follower roller 12 is pressed against the upper driver roller 11, and a paper-discharging follower roller 13 is pressed against the upper driver roller 11 from the opposite side, sandwiching the upper driver roller 11 with the paper-supplying follower roller 12. These two follower rollers 12 and 13 are adapted to rotate by following the motion of the upper driver roller 11. The combination of these three rollers (the upper driver roller 11, the paper-supplying follower roller 12 and the paper-discharging follower roller 13) is sometimes referred to as "the tri-roller."

At a position inside the passage 15 vertically below the tri-roller, there is provided another driver roller ("the lower driver roller 16") adapted to be rotated in the clockwise direction by means of another motor (not shown), and another follower roller 18 is disposed opposite thereto. The rotary shaft of this follower roller 18 is supported by a solenoid 17 such that the follower roller 18 is movable horizontally (to the left and the right with reference to FIG. 1) by this solenoid 17. When the follower roller 18 is moved by the solenoid 17 to the left, a gap appears between the follower roller 18 and the lower driver roller 16 for passing a paper sheet therethrough. When the solenoid 17 moves the follower roller 18 to the right, the follower roller 18 is pressed against the lower driver roller 16 and rotates therewith.

The front edge of a paper sheet 2 transported to the paper reversing device 1 is brought to the start position 15*a* of the passage 15 so as to be clamped between the upper driver roller 11 and the paper-supplying follower roller 12 and guided vertically downward through the passage 15. At this moment, the lower driver roller 16 is not activated and the follower roller 18 is retracted to the left by the solenoid 17, leaving a gap so as to allow the paper sheet 2 to pass therethrough.

After the front edge of the paper sheet 2 passes through the gap between the lower driver roller 16 and the follower roller 18, the follower roller 18 is moved to the right by the solenoid 17 such that the paper sheet 2 becomes clamped therebetween. Since the lower driver roller 16 is not driven yet, however, it is caused to rotate in the counter-clockwise direction by the downward motion of the paper sheet 2 (while the follower roller 18 is thereby caused to rotate in the clockwise direction). In other words, the paper sheet 2 continues to be transported downward inside the passage 15.

As the back edge of the paper sheet 2 passes the contact point between the upper driver roller 11 and the paper-supplying follower roller 12, the lower driver roller 16 starts to be driven by the associated motor, rotating in the clockwise direction and thereby causing the paper sheet 2 to reverse the direction of its motion and to move in the vertically upward direction inside the passage 15, while remaining clamped between the lower driver roller 16 and the follower roller 18. Thus, the upwardly moving paper sheet 2 is discharged out of the passage 15 from its back end while being sandwiched between the upper driver roller 11 and the paper-discharging follower roller 13.

In summary, the paper reversing device 1 serves to supply the paper sheet 2 downward into the passage 15 from its front edge, to reverse the direction of transportation of the paper sheet 2 after the supplying is completed (when its back edge is brought inside the passage 15) and to discharge it out of the passage 15 from its back edge by moving it upward. Such a mode of supplying and discharging a paper sheet by means of a tri-roller as described above, that is, the mode of using a driver roller and a paper-supplying follower roller to supply a paper sheet and using the same driver roller and a paper-discharging follower roller to discharge the paper sheet is commonly referred to as the tri-roller method.

A problem with the paper reversing device 1, as described above, is that the cross-sectional size of the passage 15 is large at its start position 15*a* where a tri-roller is disposed. As a result, the space for the paper sheet to pass through is large, giving rise to the possibility that the back end of the paper sheet 2 may not dependably move from the side of the paper-supplying follower roller 12 to the side of the paper-discharging follower roller 13 when the paper sheet 2 inside the passage 15 is about to be discharged. This probability increases in particular in the case of curled paper.

As explained above, furthermore, the paper sheet 2 which has been supplied into the passage 15 by means of the upper driver roller 11 and the paper-supplying follower roller 12 is guided downward through the passage 15. This gives rise to another possibility that the paper sheet 2 may undergo a free fall as soon as the back edge of the paper sheet 2 is released from the clamping between the upper driver roller 11 and the paper-supplying follower roller 12. This probability of free fall is particularly high if the paper sheet is thin or heavy.

SUMMARY OF THE INVENTION

It is therefore an object of this invention in view of the problems described above to provide an improved paper reversing device capable of dependably reversing the direction of motion of a paper sheet and discharging it independently of the material quality or shape of the paper sheet.

A paper reversing device embodying this invention for reversing the direction of motion of a paper sheet, with which the above and other objects of the invention can be accomplished, may be characterized as comprising a passage for guiding the paper sheet therethrough, a plurality of rollers each having a specified function and a guiding member for pressing and guiding a portion of the paper sheet in a specified direction for discharging. One of the rollers ("the first roller") is a driver roller and its rotation causes the paper sheet to be supplied (in "the first direction") into and discharged (in "the second direction") out of the passage. Another roller ("the second roller" or "the paper-supplying follower roller") is for contacting and rotating with the first roller and thereby transporting the paper sheet in the first direction into the passage. Still another roller ("the third roller" or "the paper-discharging follower roller") is disposed on the opposite side of the first roller from the second roller such that the second and third rollers sandwich the first roller therebetween, and serves for transporting the paper sheet in the second direction out of the passage by contacting and rotating with the first roller. There is still another roller ("the fourth roller") which is a driver roller disposed in the passage and serves to allow the front edge of the paper sheet to pass by when it is transported in the first direction by means of the first and second rollers. When the paper sheet has passed between the first and second rollers and its back edge has been disengaged therefrom, however, the guiding member functions to press and guide the back edge of the paper sheet towards the third roller and the four roller rotates so as the transport the paper sheet in the second direction and discharge it between and by means of the first and third rollers. In this manner, the direction of motion of the paper sheet inside the passage can be dependably reversed without regard to the material quality or the size of the paper sheet.

If the second roller and the guiding member are coaxially disposed so as to share a shaft as their common axis of rotation, their structures can be simplified. If the guiding member is designed to have a surface configured along the outer periphery of the first roller, the paper sheet can be more dependably guided towards the third roller.

The guiding member may be designed to press the paper sheet by its own weight, or by the gravitational force thereon. If the guiding member is made of an elastic material such that it pushes and guides the back edge of the paper sheet by its elastic force, the guiding of the paper sheet thereby can be effected more dependably.

The passage for the paper sheet may be preferably be designed such that the aforementioned second direction is sloped and makes a specified acute angle from the vertical direction towards the third roller. The paper sheet can then be discharged more smoothly. The angle of the slope is preferably selected to be equal to the angle made by the line which is tangent to both the first and third rollers. It is further preferable to design the passage so as to include a curved lower end part such that the paper sheet can be prevented from falling freely by its own weight inside the passage. The radius of the curvature of this curved portion may be varied according to the material characteristics of the paper sheet. This lower end part of the passage may be made detachable such that a jamming paper sheet can be removed easily. For example, the passage may be structured so as to be separable into a first passage part and a removable second passage part, connector members being provided to connect them. The passage may be formed by means of guide plates to make it openable for removing a jamming paper sheet.

A paper holder member may be disposed inside the passage for serving to hold the paper sheet so as to dependably prevent the free fall of the paper sheet in the first direction inside the passage.

A fifth roller may be further provided as a follower roller, disposed opposite the fourth roller for transporting the paper sheet in the second direction by contacting the fourth roller. An elastic member may be provided to support the shaft of the fifth roller to apply its biasing force on the fifth roller towards the fourth roller.

The fourth roller may be D-shaped in cross-section, having a straight line portion and an arcuate portion, such that the paper sheet can be passed by smoothly in the first direction when it is being supplied into the passage and transported dependably in the second direction when it is being discharged.

With a device thus structured according to this invention, each paper sheet is transported in the first direction by means of the first and second rollers but as soon as it passes through these rollers and its back edge is disengaged from them, the fourth roller begins to transport it oppositely in the second direction while its back edge is pressed and guided towards the third roller. Thus, the paper sheet is dependably discharged between the first and third rollers with the direction of its motion reversed.

BRIEF DESCRIPTION OF THE DRAWINGS

Throughout herein, corresponding components are indicated by the same numerals and may not be described repetitiously as they appear in different figures and/or indicate components of different devices.

DETAILED DESCRIPTION OF THE INVENTION

Figure 2:
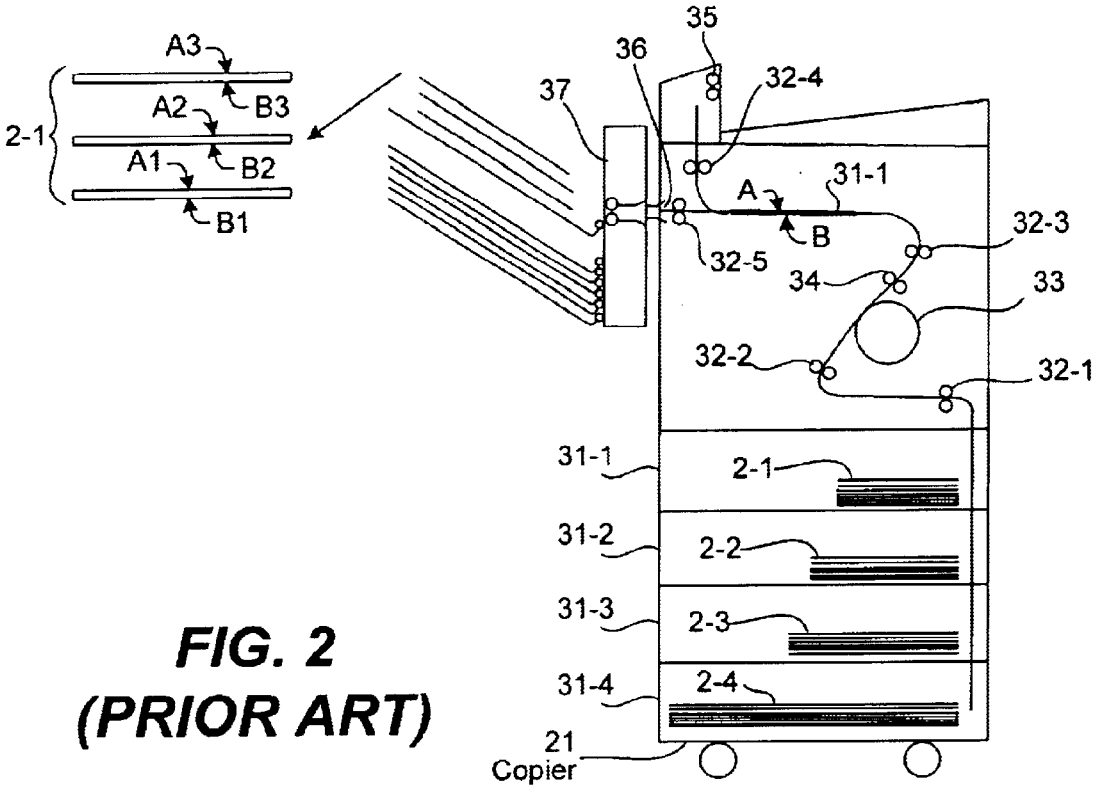
FIG. 2 (PRIOR ART)
FIG. 2 is a schematic sectional view of a copier before a paper reversing device of this invention is installed.
Figure 3:
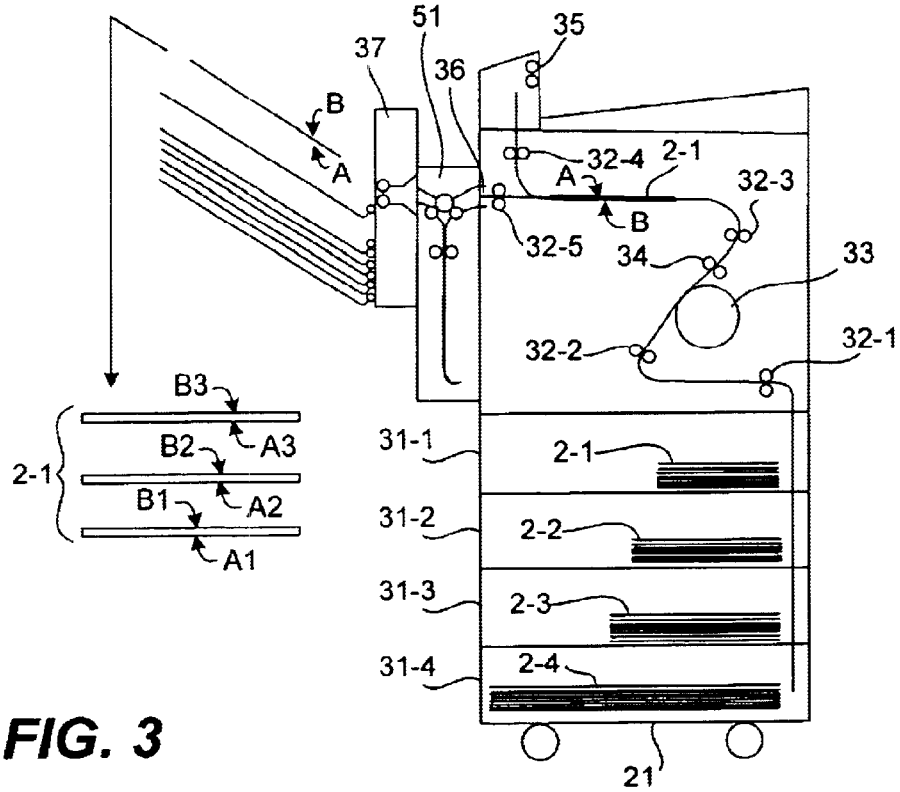
FIG. 3 is a schematic sectional view of the copier of FIG. 2 with a paper reversing device embodying this invention.

The invention is described next by way of examples. FIG. 2 shows a copier 21 without a device embodying this invention. FIG. 3 shows the same copier 21 with a paper reversing device 51 according to this invention. As shown both in FIGS. 2 and 3, the copier 21 has paper cassettes 31-1–31-4 provided in the lower part thereof for containing respectively paper sheets 2-1–2-4 of specified different sizes. Above these cassettes are rollers 32-1–32-5 for transporting these paper sheets 2-1–2-4, an image transferring drum 33 for transferring a specified image onto the paper sheets 2-1–2-4, and a fixer 34 for fixing the transferred image, as well as an upper discharge opening 35 and a lower discharge opening 36 for discharging the paper sheets 2-1–2-4 on which an image has been fixed. A sorter 37 is further provided on a side surface for sorting the paper sheets 2-1–2-4 discharged through the lower discharge opening 36 in a specified sequence.

Let letters A and B indicate respectively the lower and upper surfaces of paper sheets 2-1 in the cassette 31-1. As these paper sheets 2-1 are pulled out of the cassette 31-1 and transported by means of the roller 32-1 and 32-2, it is onto the surface A that the drum 33 transfers an image. When these paper sheets 2-1 are discharged into the sorter 37, it is through the lower discharge opening 36 by means of the rollers 32-3 and 32-5 after the image is fixed thereon by means of the fixer 34. (When they are not discharged into the sorter 37, they are discharged through the upper discharge opening 35 by means of the roller 32-4.) When they are discharged through the lower discharge opening 36, the paper sheets 2-1 are piled up sequentially in the "face-up" condition with the printed surfaces facing upward. In FIG. 2, the printed surfaces of the first, second and third pages are respectively indicated as A1, A2 and A3 and their back surfaces respectively as B1, B2 and B3. Thus, the second paper with the printed surface A2 facing upward will be piled on top of the first page with the printed surface A1 facing upward, and so forth. In other words, the printed paper sheets are piled up in the reverse order.

Thus, it is preferable to insert a paper reversing device 51 between the lower discharge opening 36 and the sorter 37, as shown in FIG. 3. With a paper reversing device 51 thus inserted in the copier 21, the paper sheets 2-1 discharged from the lower discharge opening 36 with the printed surface A facing upward are each turned over by the paper reversing device 51 and discharged therefrom with the printed surface A facing downward. Thus, the discharged paper sheets 2-1 are piled up in the correct order as they are discharged from the sorter 37, as shown in FIG. 3. The same explanation applies to printers and facsimile machines, as well as to copiers.

Figure 4:
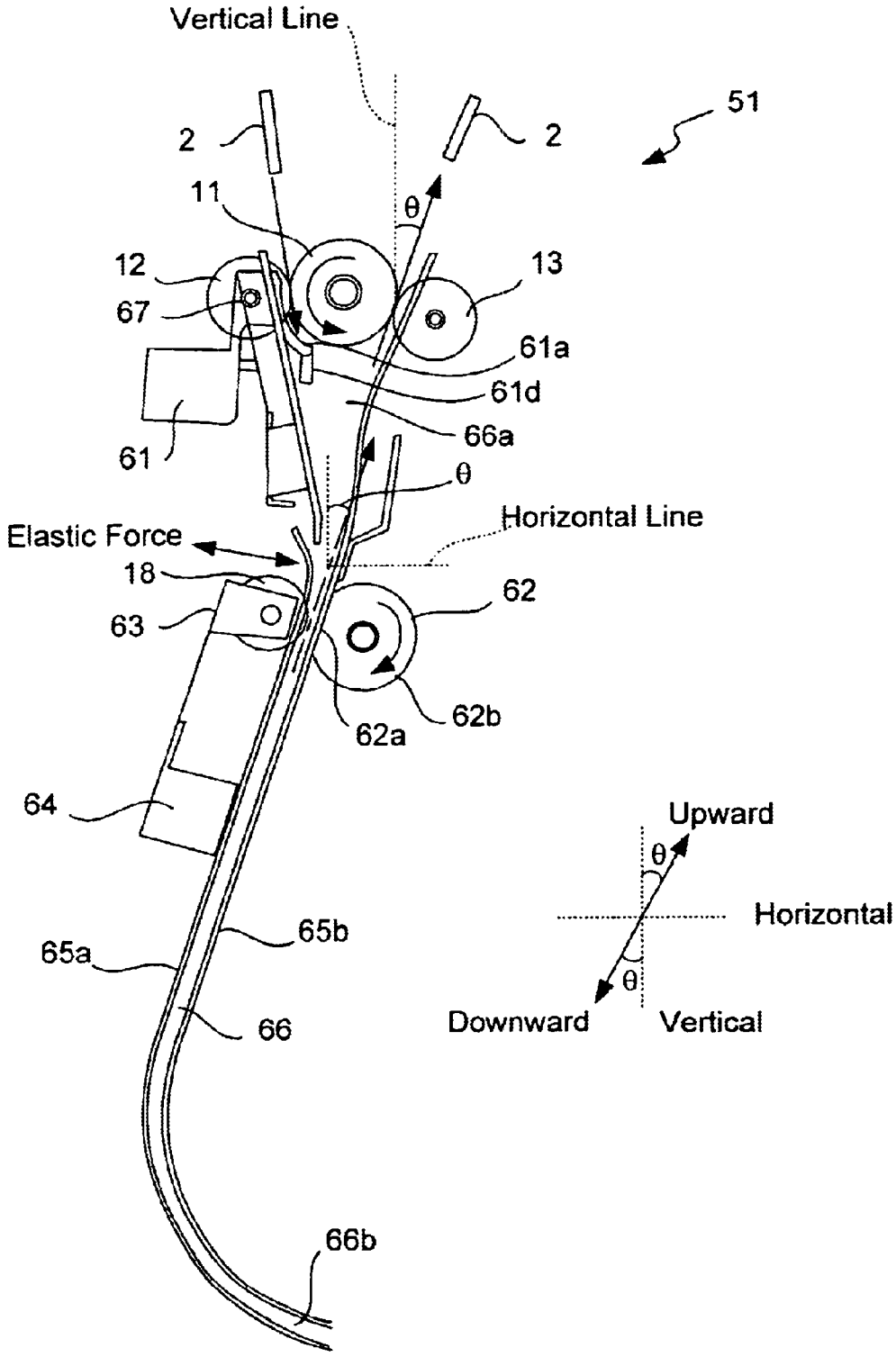
FIG. 4 is a sectional view of a paper reversing device according to a first embodiment of this invention.

The structure of the paper reversing device 51 according to a first embodiment of the invention is explained next with reference to FIGS. 4 and 5. As shown in FIG. 4, the paper reversing device 51 has a passage 66 formed by guide plates 65*a* and 65*b*, sloping at an angle θ from the vertical direction towards the paper-discharging follower roller 13 ("the third roller"). According to this example, this angle θ is selected to be equal to the sloping angle of the line which is tangent to both the upper driver roller 11 ("the first roller") and the paper-discharging follower roller 13. In what follows, the upward and downward directions along this sloped passage 66 will be simply referred to as the upward and downward directions.

The reason for thus sloping the passage 66 is to make it easier to guide a paper sheet 2 smoothly in the direction of the paper-discharging following roller 13 when it is being discharged. The passage 66 is also curved at its lower end part 66*b* for preventing the free fall (or free downward sliding) of the paper sheet 2 and also for reducing the total size of the device. The curvature of the lower end part 66*b* of the passage 66 may be made variable in order to make it suitable for different kinds of paper sheet with different material characteristics.

Figure 1:
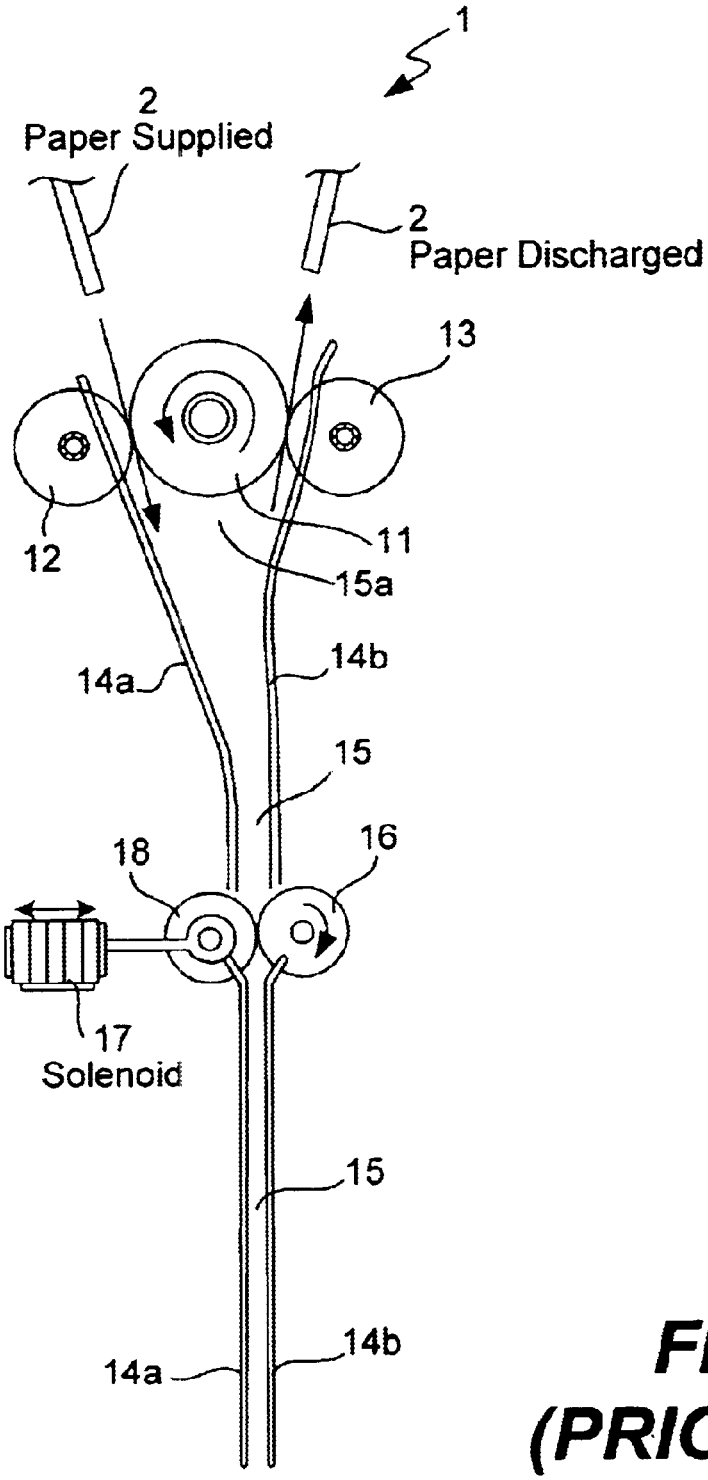
FIG. 1 (PRIOR ART)
FIG. 1 is a schematic sectional view of a prior art paper reversing device.

A driver roller 11 is disposed at the top end part 66*a* of the passage 66, sandwiched between the paper-supplying follower roller 12 ("the second roller") and the paper-discharging follower roller 13, that is, there is a tri-roller as shown in FIG. 1 and paper sheets are supplied and discharged by the tri-roller method.

Figure 5:
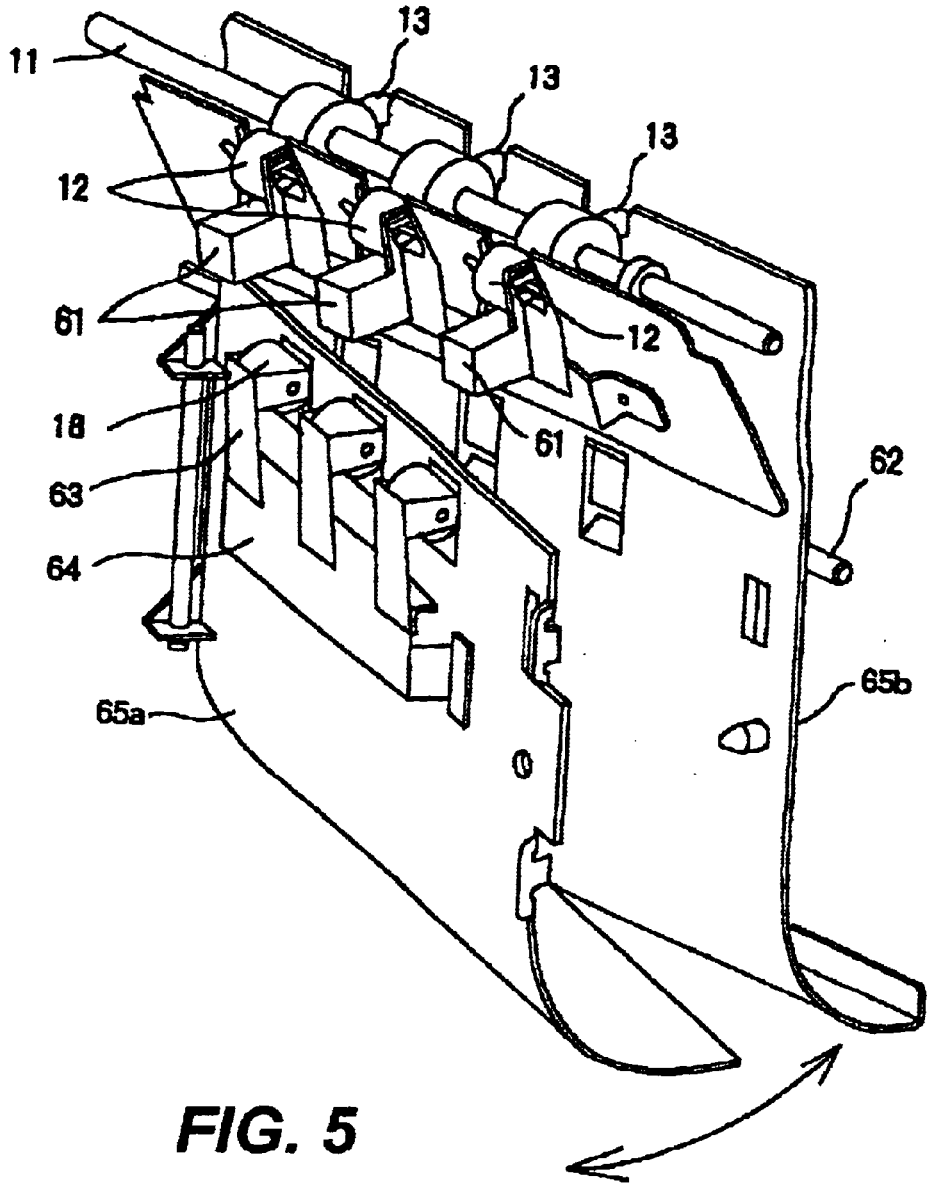
FIG. 5 is a diagonal external view of the paper reversing device of FIG. 4.

As shown in FIG. 5, the guide plate 65*a* may be opened and closed. When there is a jam, the user may open the guide plate 65*a* and remove the jammed paper remaining in the passage 66.

Figure 6:
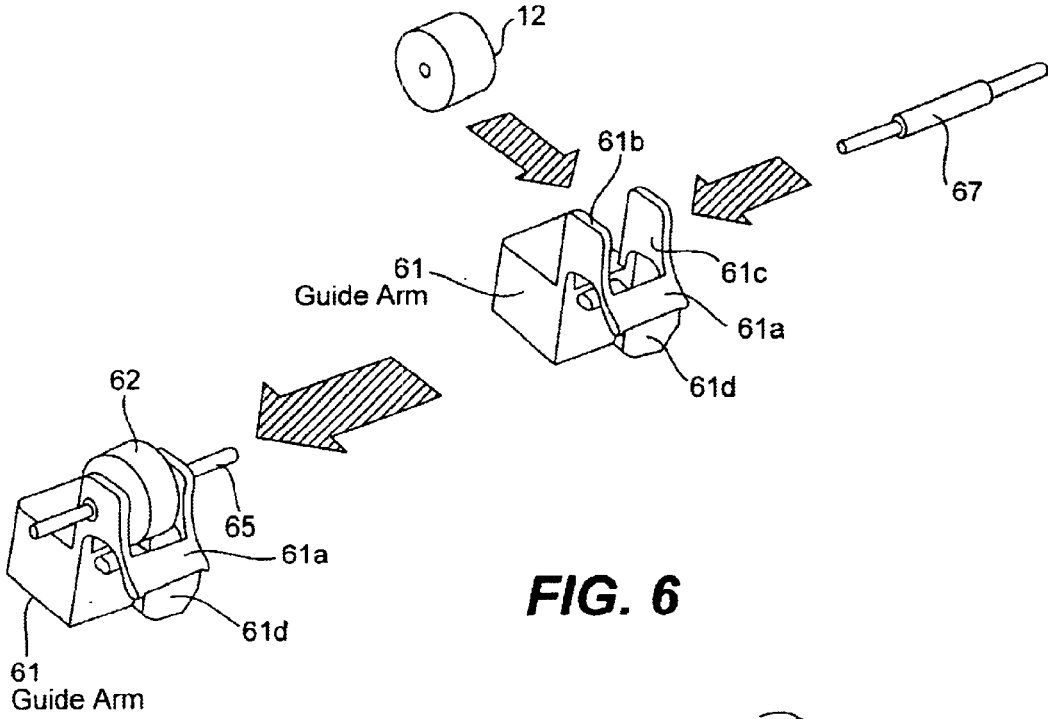
FIG. 6 is a diagonal external view of the guide arm and the paper-supplying follower roller of FIG. 4 according to one example.
Figure 9:
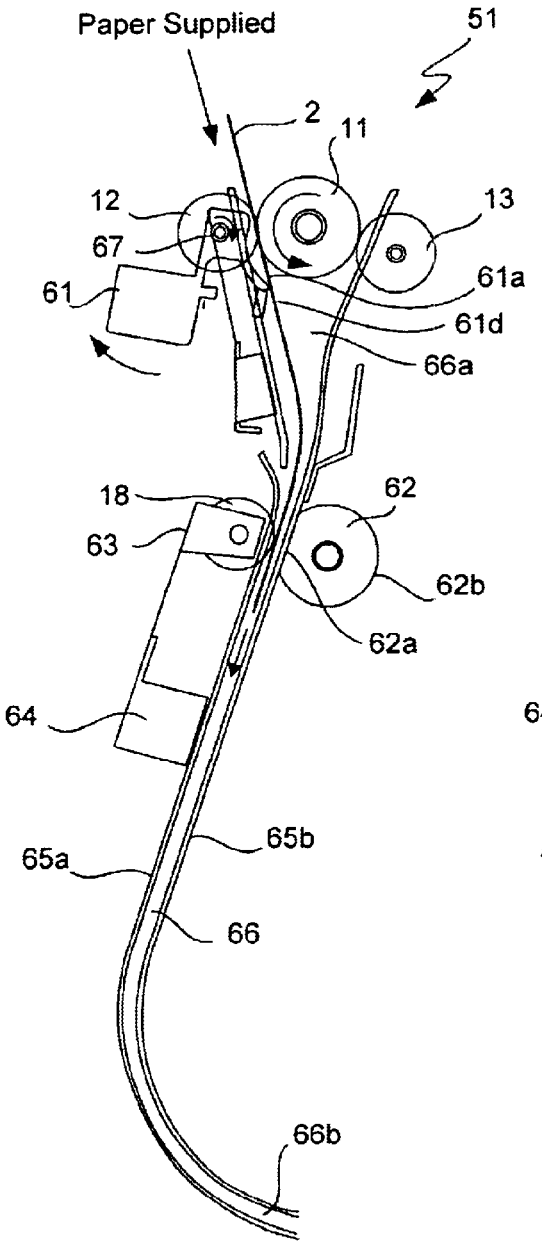
FIG. 9 is a sectional view of the paper reversing device of FIG. 4 when a paper sheet is being supplied into it.

As shown in FIG. 6, the paper-supplying follower roller 12 is inserted between two surfaces 61*b* and 61*c* of a guide arm 61 and its center is connected to the guide arm 61 through a shaft 67. As shown in FIG. 4, the paper-supplying follower roller 12 and the guide arm 61 share the shaft 67 as axis of rotation at the top end part 66*a* of the passage 66 such that the device 51 can be made compact. The guide arm 61 is further provided with a surface 61*a* having the same shape as the outer periphery of the driver roller 11 and being adapted to be along this outer periphery and another surface 61*d* for pressing the paper sheets 2. Thus, when a paper sheet 2 is being transported by means of the driver roller 11 and the paper-supplying follower roller 12, the guide arm 61 is pushed upward around the shaft 67 by the paper sheet 2, as shown in FIG. 9, such that its surface 61*a* follows the contour along the outer periphery of the driver roller 11.

Figure 10:
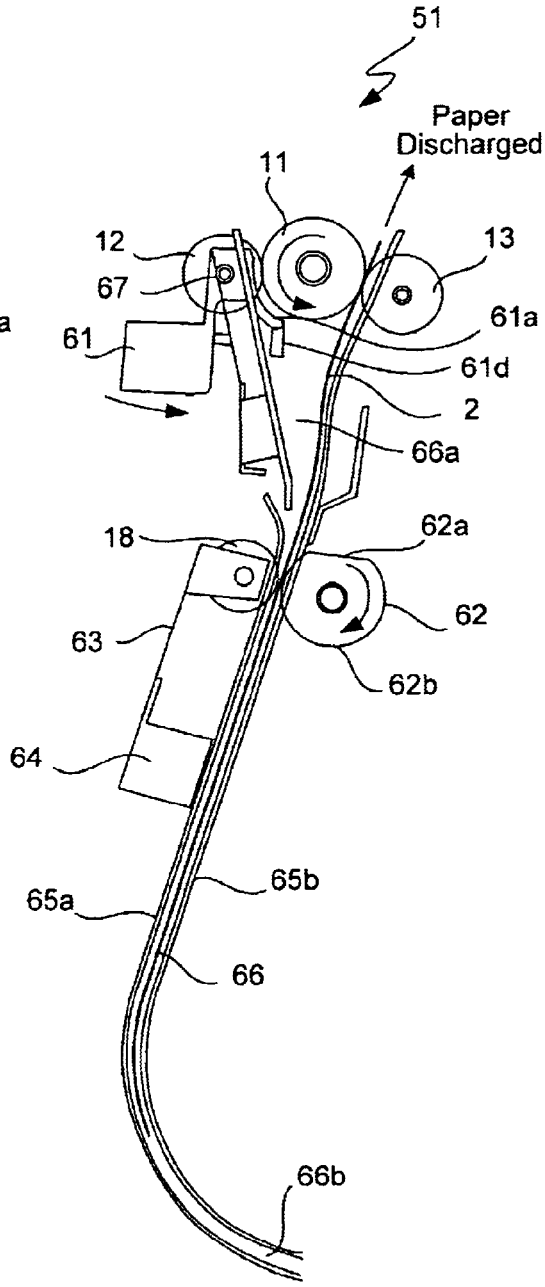
FIG. 10 is a sectional view of the paper reversing device of FIG. 4 when a paper sheet is being discharged from it.

When a paper sheet 2 is being discharged from the device 51, as shown in FIG. 10, the guide arm 61 is pushed downward around the shaft 67 by its own weight with its surface 61*a* following the contour of the outer periphery of the driver roller 11. As the guide arm 61 is thus being pushed downward, its surface 61*d* presses the paper sheet 2 which is being upwardly transported and thereby guides it away from the paper-supplying follower roller 12 towards the paper-discharging follower roller 13. The guide arm 61, thus serving to function by its own weight, or by a gravitational force thereon, may preferably be made of a material with small plastic deformation such as a metal plate, a resin material or a sponge. If the guide arm 61 is made of such a material, the pressure on the paper sheet 2 applied thereby can be made approximately uniform with only small variations. The weight of such a guide arm may be varied according to the type of the paper sheets to be used.

Although a mechanism of the guide arm 61 making use of its own weight to guide the paper sheet towards the paper-discharging follower roller 13 was disclosed above, this is not intended to limit the scope of the invention. Use may be made of a guide arm provided with an elastic member such as a spring with a controllable spring constant for guiding a paper sheet from the paper-supplying follower roller 12 towards the paper-discharging follower roller 13.

With reference again to FIG. 4, there is provided along the passage 66 and below the tri-roll at the top end part 66*a* of the passage 66 a D-shaped driver roller 62 ("the fourth roller") adapted to rotate in the clockwise direction by means of a motor (not shown), having its straight portion 62*a* normally contacting the guide plate 65*b* of the passage 66 when it is not being rotated by the motor. Thus, as a paper sheet 2 is downwardly transported through the passage 66 by means of the paper-supplying follower roller 12 and the driver roller 11, its front edge passes smoothly along this straight portion 62*a* of the periphery of the D-shaped driver roller 62. In this manner, the problem with prior art driver rollers can be largely obviated.

After the back end of the paper sheet 2 is disengaged from and leaves the paper-supplying follower roller 12 and the driver roller 11, the D-shaped driver roller 62 is activated and begins to rotate in the clockwise direction (like the lower driver roller 16 described above with reference to FIG. 1). A follower roller 18 ("the fifth roller" structured as described above with reference to FIG. 1) is thereby pressed against the arcuate portion 62*b* of the D-shaped driver roller 62, as shown in FIG. 10, and rotated therewith. Thus, when the D-shaped driver roller 62 is activated, the paper sheet 2 is clamped between the D-shaped driver roller 62 and its follower roller 18 and transported upward inside the passage 66. The shaft of the follower roller 18 is supported by a spring 63 adapted to apply a biasing force on the follower roller 18 in the direction of the D-shaped driver roller 62.

Figure 7A:
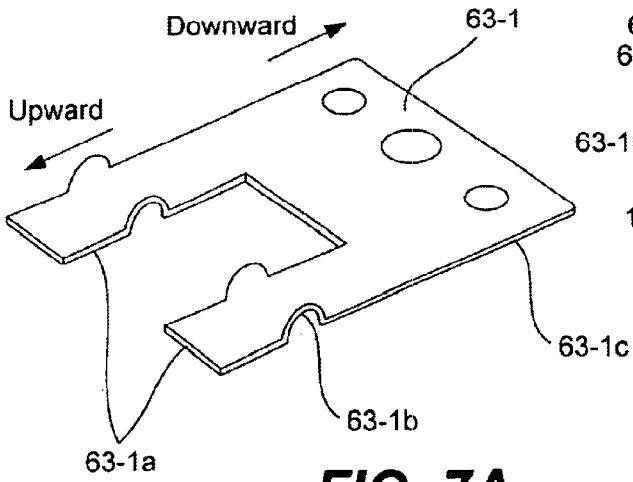
FIGS. 7A and 7B, together referred to as FIG. 7, are respectively a diagonal external view and a side view of a spring which may be used in the paper reversing device of FIG. 4.
Figure 7B:
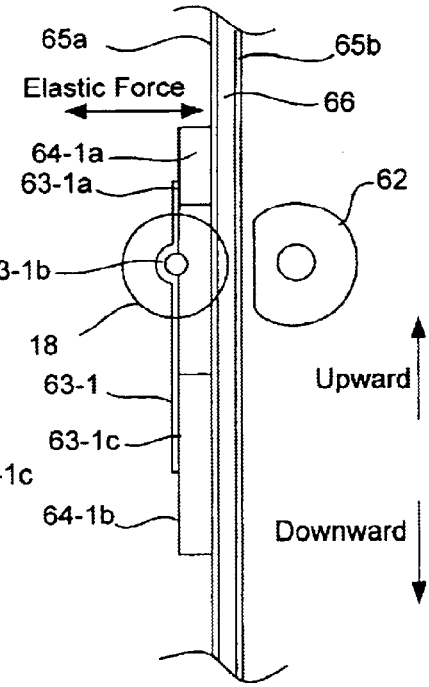
Figure 8A:
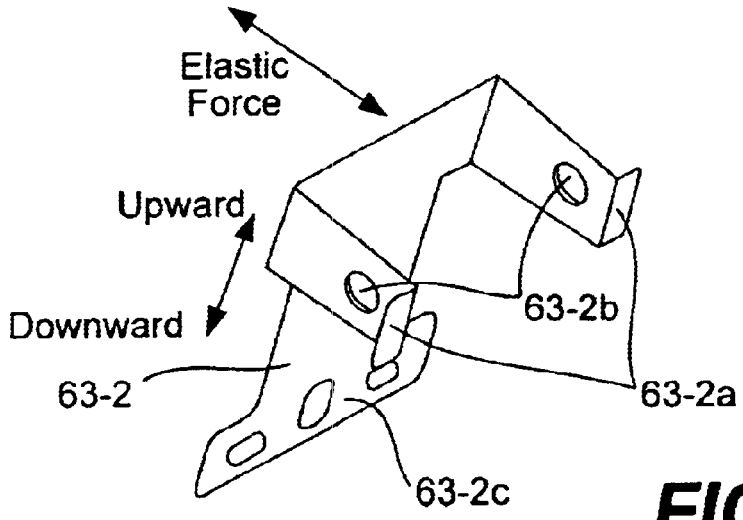
FIGS. 8A and 8B, together referred to as FIG. 8, are respectively a diagonal external view and a side view of another spring which may be used in the paper reversing device of FIG. 4.
Figure 8B:
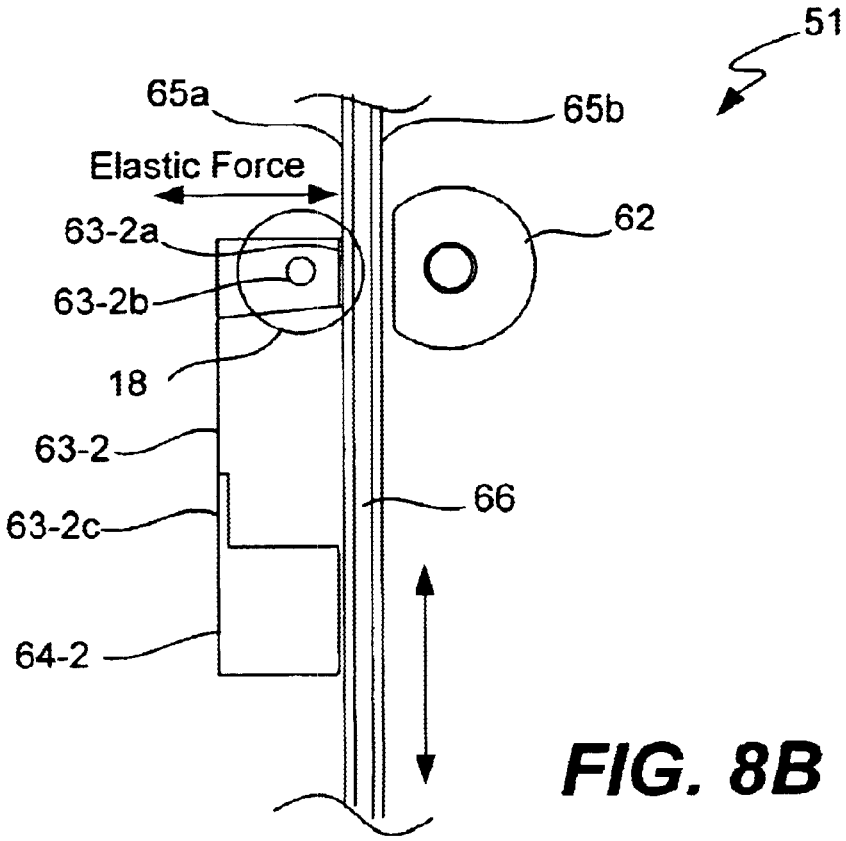

FIGS. 7 and 8 are referenced next to explain examples of the spring 63. FIG. 7 shows a spring 63-1 according to a first example, having bent parts 63-1*a*, shaft-receiving parts 63-1*b* and a fixed planar part 63-1*c*. It is set such that the bent parts 63-1*a* contact a member 64-1*a* secured onto the guide plate 65*a*, that the shaft-receiving parts 63-1*b* support the shaft of the follower roller 18, and that the fixed planar part 63-1*c* is affixed to another member 64-1*b* secured onto the guide plate 65*a*.

The bent parts 63-1*a* serve to prevent the follower roller 18 supported by the shaft-receiving parts 63-1*b* from becoming displaced in the direction of the D-shaped driver roller 62 by a distance greater than a specified length. Since these bent parts 63-1*a* are provided in the direction of the elastic force of the spring 63-1, as shown in FIG. 7, the position of the follower roller 18 cannot be definite because of the variation in the elastic force of the spring 63-1. When a paper sheet 2 is being supplied and moving downward, a sufficient space for passing the paper sheet 2 may not be dependably secured between the follower roller 18 and the D-shaped driver roller 62.

When the paper sheet 2 is being discharged and moving upward, the pressure on the paper sheet 2 between the follower roller 18 and the D-shaped driver roller 62 may fluctuate.

In view of these problems, it is preferable to use a spring 63-2 as shown in FIG. 8, adapted to be disposed in the device 51, characterized also as having bent parts 63-2*a*, shaft-receiving parts 63-2*b* and a fixed planar part 63-2*c* but additionally wherein the bent parts 63-2*b* are perpendicular to the direction of the elastic force of the spring 63-2. The spring 63-2 thus structured is set in the device 51, as shown in FIG. 8, with its bent parts 63-2*a* contacting the guide plate 65*a*, its shaft-receiving parts 63-2*b* supporting the shaft of the follower roller 18 and its fixed planar part 63-2*c* secured to a member 64-2 affixed to the guide plate 65*a*. Thus, since the spring 63-2 has its bent parts 63-2*a* perpendicular to the direction of its elastic force and the bent parts 63-2*a* are pressed against the guide plate 65*a*, the position of the follower roller 18 supported by the shaft-receiving parts 63-2*b* can be maintained dependably without regard to the variations in the elastic force of the spring 63-2. In other words, the spring 63-2 shown in FIG. 8 can maintain the space between the follower roller 18 and the D-shaped driver roller 62 at the time of supplying a paper sheet 2 and the compressive force on the paper sheet 2 between the follower roller 18 and the D-shaped driver roller 62 at the time of discharging the paper sheet 2 more uniformly than the spring 63-1 shown in FIG. 7. In summary, the spring 63-1 shown in FIG. 7 may be used in the device 51 but the spring 63-2 shown in FIG. 8 is preferred.

Next, FIGS. 9 and 10 are referenced again to explain the operations of the paper reversing device 51. FIG. 9 shows the device 51 when a paper sheet 2 is being supplied, and FIG. 10 shows the same device 51 when the paper sheet 2 has had its direction of motion reversed and is being discharged.

As shown in FIG. 9, the front edge of a paper sheet 2, as it is supplied to the device 51 from the lower discharge opening 36 shown in FIG. 3, is clamped between the upper driver roller 11 and the paper-supplying follower roller 12 to the top end part 66*a* of the passage 66 and guided downward through the passage 66. During this operation, the guide arm 61 is pushed upward by the paper sheet 2 by using the shaft 67 as the axis of rotation, and the D-shaped driver roller 62 is not activated but remains in the condition shown in FIG. 9. Thus, the front edge of the paper sheet 2 passes directly downward along the straight portion 62*a* of the D-shaped driver roller 62 until it reaches the lower end part 66*b* of the passage 66.

As the back edge of the paper sheet 2 is disengaged from the upper driver roller 11 and the paper-supplying follower roller 12, the device 51 terminates the paper-supplying portion of the operations and starts the operations for reversing the direction of motion of the paper sheet 2 and discharging it. For this portion of the operations, the D-shaped driver roller 62 is activated, say, by means of a motor, and starts to rotate in the clockwise direction, as shown in FIG. 10. During this time, the guide arm 61 is pushed downward due to its own weight, using the shaft 67 as the axis of rotation. The paper sheet 2 may tend to undergo a free fall motion by freely sliding downward inside the passage 66 but the lower end part 66*b* of the passage 66 is curved and serves as a stopper, preventing such a free falling motion and keeping the paper sheet 2 remaining inside the passage 66.

As the arcuate portion 62*b* of the D-shaped driver roller 62 comes to contact the follower roller 18 with the paper sheet 2 in between, the paper sheet 2 reverses the direction of its downward motion and is transported upward inside the passage 66 in this clamped condition. The upwardly moving paper sheet 2 is pushed from its back edge part by the surface 61*d* of the guide arm 61 from the side of the paper-supplying follower roller 12 towards the paper-discharging follower roller 13 and discharged out of the passage 66 by means of the upper driver roller 11 and the paper-discharging follower roller 13.

Figure 11:
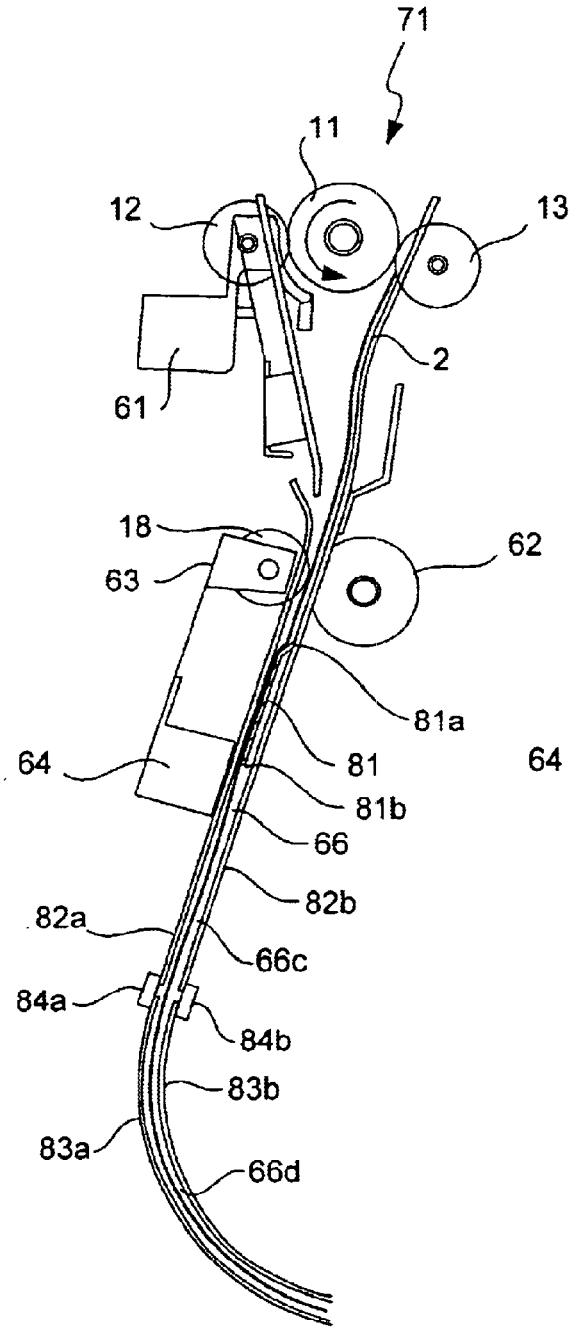
FIG. 11 is a sectional view of another paper reversing device according to a second embodiment of the invention.

FIG. 11 shows another paper reversing device 71 embodying this invention, indicating like or equivalent components by the same symbols as used in FIG. 4 for the device 51 according to the first embodiment of the invention. The device 71 according to this embodiment is characterized as further comprising a paper holding member 81 made of a resin material, Mylar or sponge disposed inside the passage 66 below the D-shaped driver roller 62.

As shown in FIG. 11, the paper holding member 81 has its upper end portion 81*a* affixed to a guide plate 82*b* and its lower end portion 81*b* remains unattached. With the paper holding member 81 thus provided, the front edge of the paper sheet 2 which is guided downward through the passage 66 pushes down the lower end portion 81*b* of the paper holding member 81 towards the guide plate 82*b* such that a space for passing the paper sheet 2 through is dependably secured between the guide plate 82*a* and the paper holding member 81. Thus, while the paper reversing device 71 is supplying a paper sheet 2 by means of the driver roller 11 and the paper-supplying follower roller 12, the paper sheet 2 can pass through the space between the paper holder member 81 and the guide plate 82*a*.

When the device 71 finishes the paper-supplying operation and the back edge of the paper sheet 2 becomes disengaged from the driver roller 11 and the paper-supplying follower roller 12, the lower end portion 81*b* of the paper holder member 81 is pushed upward toward the guide plate 82*a* by naturally returning to its original form and the paper sheet 2 is dependably held between the paper holder member 81 and the guide plate 82*a*, prevented from falling downward freely.

The passage 66 is further divided into the first passage part 66*c* formed by guide plates 82*a* and 82*b* (from the top end part 66*a* to a point above the lower end part 66*b*) and a second passage part 66*d* formed by guide plates 83*a* and 83*b* (corresponding to the curved portion of the curved lower part 66*b* shown in FIG. 4), connected together by means of connector members 84*a* and 84*b* such that the second passage part 66*d* can be disconnected and separated from the first passage part 66*d*, as separately shown in FIG. 11. In the case of a jam, the user may remove the guide plate 65*a* to remove the jamming paper sheet, as explained above with reference to FIG. 5, but the user may alternatively remove the second passage part 66*d* to remove the jamming paper sheet 2.

In other respects, the device 71 according to the second embodiment of the invention is the same and operated similarly as the device 51 according to the first embodiment described above. It also goes without saying that the device 71 may be attached not only to the copier 21 but also to an apparatus of a different kind such as a printer and a facsimile machine.

Figure 12:
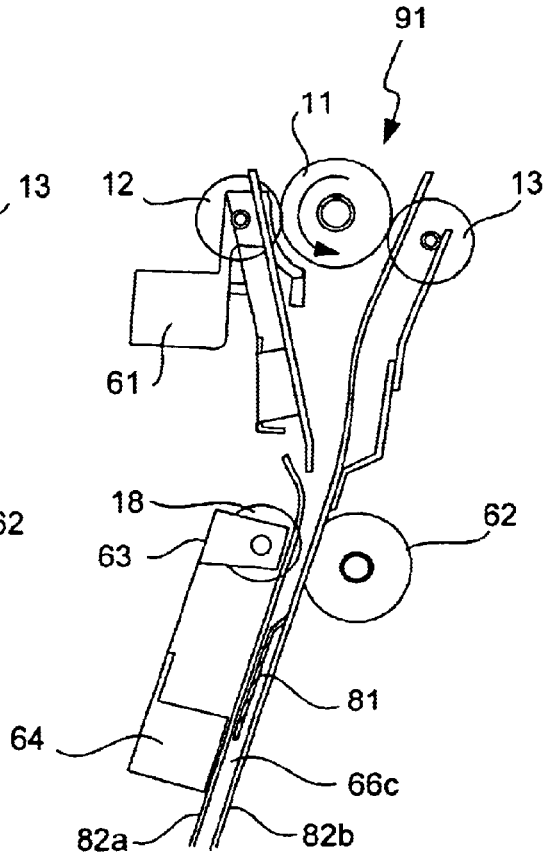
FIG. 12 is a sectional view of still another paper reversing device according to a third embodiment of the invention.

FIG. 12 shows still another paper reversing device 91 embodying this invention, indicating like or equivalent components by the same symbols as used in FIG. 11 for the device 71 according to the second embodiment of the invention. The device 91 according to this embodiment is characterized wherein the second passage part 66*d* (and hence the guide plates 83*a* and 83*b*) and the connector members 84*a* and 84*b* of the device 71 according to the second embodiment are removed. This is to say that these components removed from the device 71 to form the device 91 are not indispensable because of the presence of the paper holder member 81. The advantage of the third embodiment is that the device 91 is much more compact.

In other aspects, the device 91 according to the third embodiment of the invention is the same and operated similarly as the device 71 according to the second embodiment described above. It also goes without saying that the device 91 may be attached not only to the copier 21 but also to an apparatus of a different kind such as a printer and a facsimile machine.

What is claimed is:

1. A device for reversing direction of motion of a paper sheet, said paper sheet having a front edge and a back edge opposite each other, said device comprising:

a passage for guiding said paper sheet in a first direction and a second direction which is opposite said first direction;

a first roller for rotating and thereby transporting said paper sheet;

a second roller for transporting said paper sheet in said first direction into said passage by contacting said first roller;

a third roller, for transporting said paper sheet in said second direction out of said passage by contacting said first roller, said first roller being positioned between said second roller and said third roller;

a fourth roller disposed in said passage for allowing said front edge of said paper sheet to pass by when said paper sheet is transported in said first direction by means of said first roller and said second roller and for rotating and thereby transporting said paper sheet in said second direction when said back edge of said paper sheet has been disengaged from said first roller and said second roller; and a guiding member disposed coaxially with said second roller for pressing and guiding said back edge of said paper sheet towards said third roller when said paper sheet has passed between and said back edge has been disengaged from said first roller and said second roller.

2. The device of claim 1 wherein said guiding member has a surface configured along an outer periphery of said first roller.

3. The device of claim 1 wherein a gravitational force acting on said guiding member presses and guides said back edge.

4. The device of claim 1 wherein said guiding member is made of an elastic material having an elastic force and presses and guides said back edge by said elastic force.

5. The device of claim 1 wherein said second direction makes a specified acute angle with a vertically upward direction towards said third roller.

6. The device of claim 1 further comprising a paper holder member disposed inside said passage for holding said paper sheet to prevent a free fall thereof in said first direction inside said passage.

7. The device of claim 1 further comprising:

a fifth roller disposed opposite said fourth roller for transporting said paper sheet in said second direction by contacting said fourth roller; and an elastic member supporting a shaft of said fifth roller and applying a force on said fifth roller towards said fourth roller.

8. The device of claim 1 wherein said fourth roller has a D-shaped cross-section having a straight line portion and an arcuate portion.

* * * * *